US006884052B1

(12) United States Patent
Chen

(10) Patent No.: US 6,884,052 B1
(45) Date of Patent: Apr. 26, 2005

(54) AIRWAY AIRTIGHT STRUCTURE OF PNEUMATIC TOOL

(76) Inventor: Hsin-Chi Chen, 5F, No. 140, Yu-Hseng Rd., Taiping City, Taichung Hsien (TW)

( * ) Notice: Subject to any disclaimer, the term of this patent is extended or adjusted under 35 U.S.C. 154(b) by 0 days.

(21) Appl. No.: 10/717,585

(22) Filed: Nov. 21, 2003

(51) Int. Cl.[7] ..... F01C 1/344; F01C 21/12

(52) U.S. Cl. ..... 418/270; 173/169

(58) Field of Search ..... 418/259, 270; 173/168, 169

(56) References Cited

U.S. PATENT DOCUMENTS 5,346,024 A * 9/1994 Geiger et al. ..... 418/270
6,634,438 B1 * 10/2003 Pusateri et al. ..... 173/169

* cited by examiner

*Primary Examiner*—Theresa Trieu
(74) *Attorney, Agent, or Firm*—Dennison, Schultz, Dougherty & MacDonald

(57) ABSTRACT

An airway airtight structure of pneumatic tool, including: a main body having a body section, a cylindrical chamber being formed in the body section, an inlet being formed in a predetermined position of a wall of the chamber for communicating with an incoming passage of the pneumatic tool; a cylinder member having a hollow cylindrical body coaxially accommodated in the chamber, a wall of the cylindrical body being spaced from the inlet; and a connecting section positioned in a position where an opening of the inlet is directed, the connecting section being sandwiched between the cylindrical body and the wall of the chamber. The connecting section includes two mating bodies mated with each other. A connecting face is positioned between the opposite mating ends of the mating bodies and inclined from the axis of the cylindrical body by a predetermined inclination angle. A connecting airway is formed on the mating bodies and extends through the connecting face to communicate with the inlet.

6 Claims, 6 Drawing Sheets

AIRWAY AIRTIGHT STRUCTURE OF PNEUMATIC TOOL

BACKGROUND OF THE INVENTION

The present invention is related to a pneumatic tool, and more particularly to an airway airtight structure of pneumatic tool.

FIG. 1 shows the high pressure airflow path of a conventional pneumatic tool 1. A connecting airway 4 is formed between the pneumatic cylinder 2 and the main body 3. The connecting airway 4 is a close space defined by the walls of the internal chambers of the pneumatic cylinder and the main body. The connecting airway 4 has a perforation for communicating the connecting airway 4 with other internal space of the pneumatic tool 1 to form a complete airflow path.

With respect to the connecting airway 4 of the conventional technique, the mating plane face between the cylinder and the main body is parallel to the axis of the cylindrical body of the pneumatic cylinder. In addition, the cylinder is connected with the main body by several thread rods parallel to the axis of the cylindrical body. In other words, the direction of the connecting force between the cylinder and the main body is parallel to the connecting plane face. Accordingly, the connecting force cannot truly provide an airtight effect for the connecting airway 4 defined by the cylinder 2 and the main body 3. As a result, it cannot be ensured that the connecting airway keeps in an airtight state. Therefore, the air may escape.

SUMMARY OF THE INVENTION

It is therefore a primary object of the present invention to provide an airway airtight structure of pneumatic tool, by which the airway between the main body and the cylinder can be truly kept in an airtight state to avoid escape of the air.

According to the above object, the an airway airtight structure of pneumatic tool of the present invention includes: a main-body having a body section, a cylindrical chamber being formed in the body section, an inlet being formed in a predetermined position of a wall of the chamber for communicating with an incoming passage of the pneumatic tool; a cylinder member having a hollow cylindrical body coaxially accommodated in the chamber, a wall of the cylindrical body being spaced from the inlet; and a connecting section positioned in a position where an opening of the inlet is directed, the connecting section being sandwiched between the cylindrical body and the wall of the chamber. The connecting section includes two mating bodies mated with each other. A connecting face is positioned between the opposite mating ends of the mating bodies and inclined from the axis of the cylindrical body by a predetermined inclination angle. A connecting airway is formed on the mating bodies and extends through the connecting face to communicate with the inlet.

The present invention can be best understood through the following description and accompanying drawings wherein:

DETAILED DESCRIPTION OF THE PREFERRED EMBODIMENT

Figure 1:
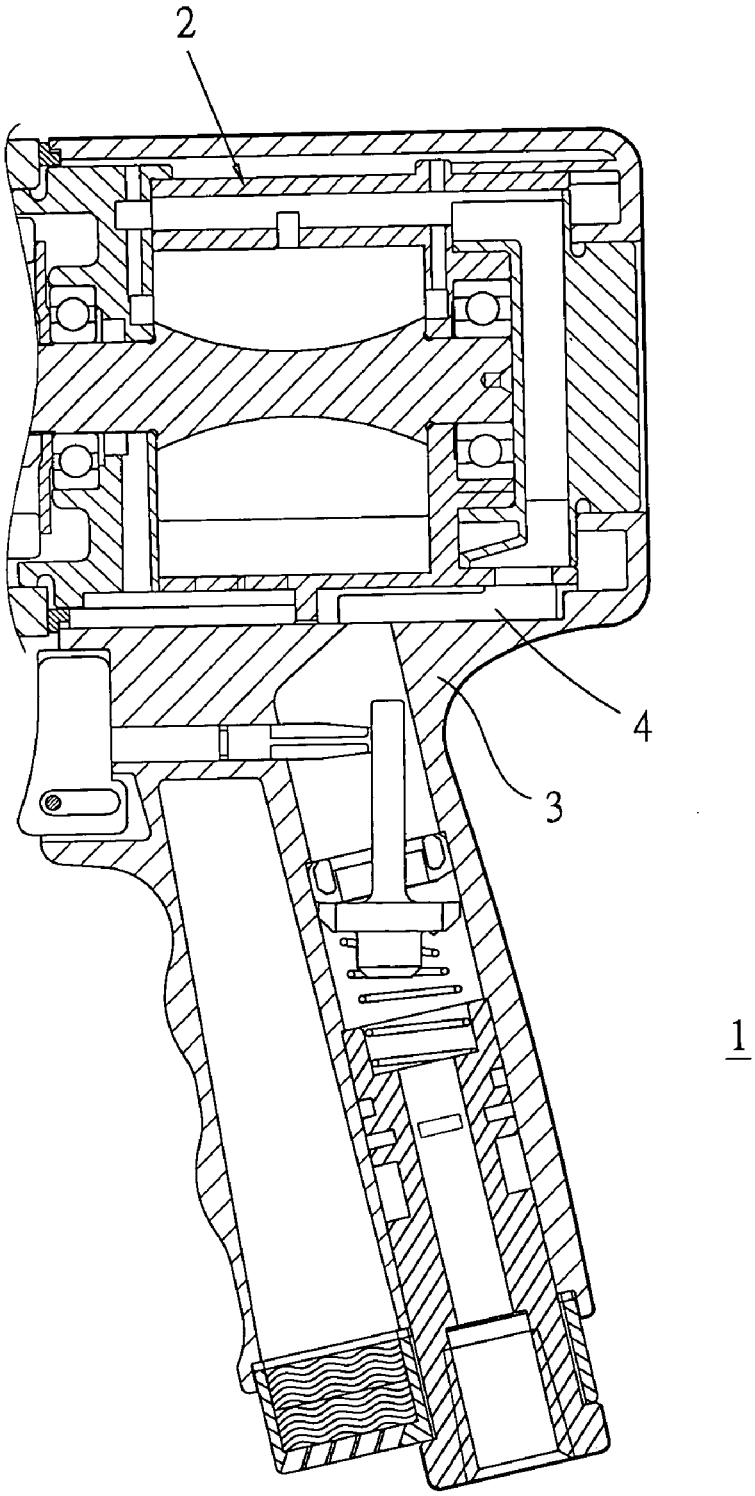
Fig. 1 Prior Art
FIG. 1 is a sectional view of prior art.
Figure 2:
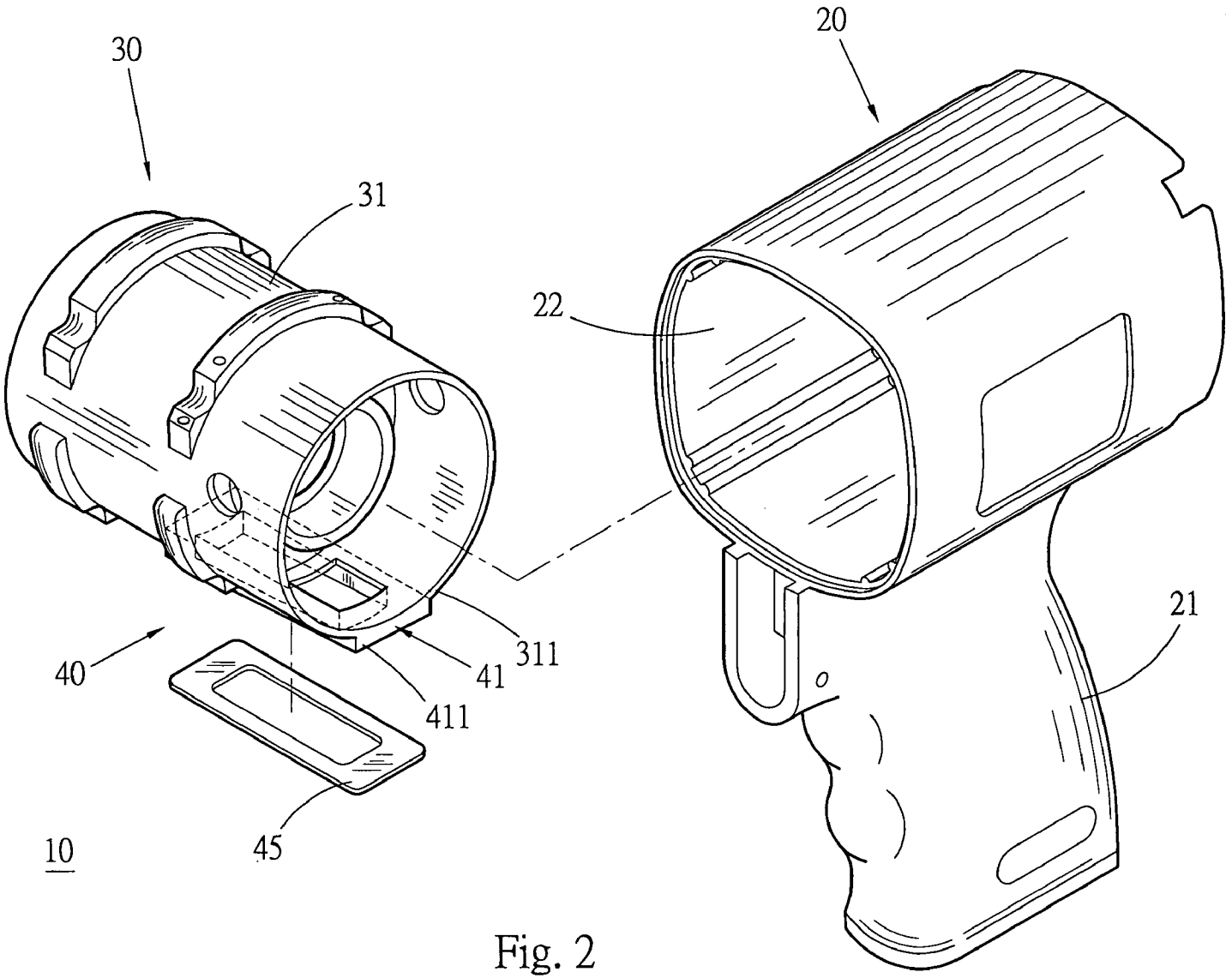
FIG. 2 is a perspective exploded view of a preferred embodiment of the present invention.
Figure 3:
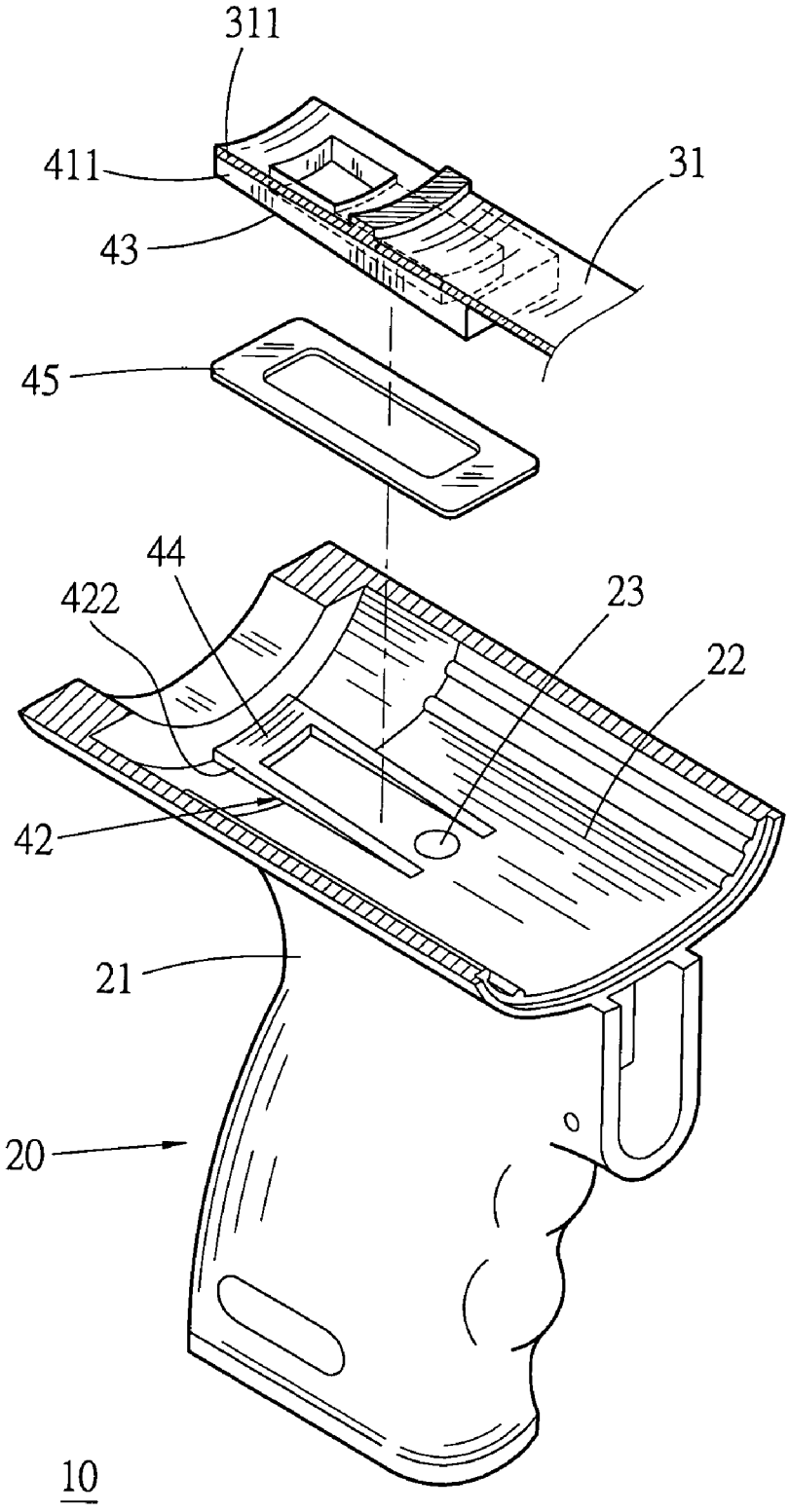
FIG. 3 is a perspective exploded sectional view of the preferred embodiment of the present invention.
Figure 4:
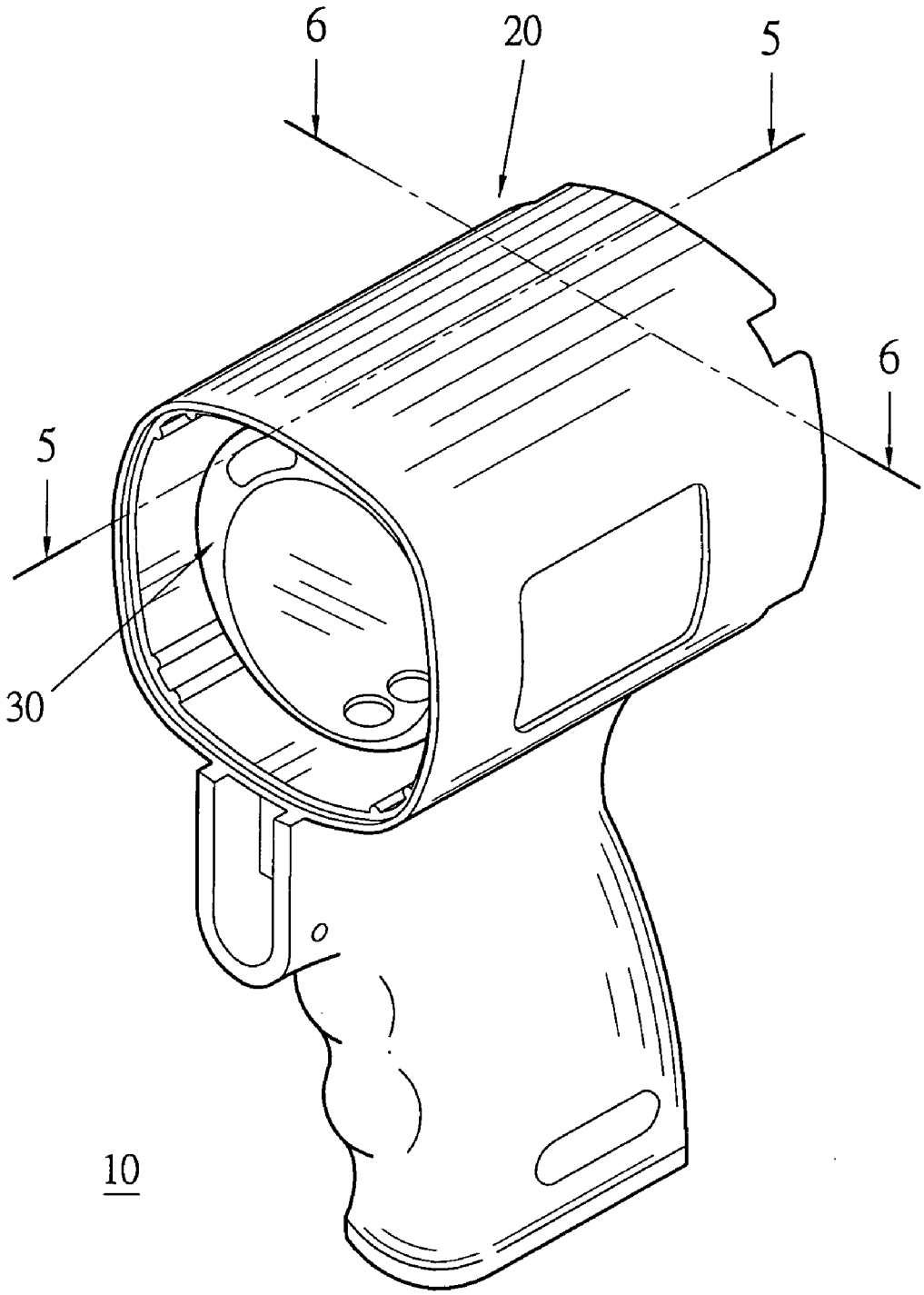
FIG. 4 is a perspective assembled view of the preferred embodiment of the present invention.

Please refer to FIGS. 2 to 6. The airway airtight structure 10 of the pneumatic tool of the present invention includes a main body 20, a cylinder member 30 and a connecting section 40.

The main body 20 has a substantially gun-shaped body section 21. A cylindrical chamber 22 extends through the body section 21 from one end to the other end thereof. An inlet 23 is formed on bottom wall of the chamber 22. An incoming passage 24 extends through the handle of the body section 21 from the inlet 23 to the bottom end face of the handle for communicating with external air source.

The cylinder member 30 has a hollow cylindrical body 31 coaxially accommodated in the chamber 22. The bottom wall 311 of the cylindrical body 31 is spaced from the inlet 23.

The connecting section 40 includes an upper and a lower mating bodies 41, 42 corresponding to each other. The lower side of the upper mating body 41 has a first mating face 43. The upper side of the lower mating body 42 has a second mating face 44. An airway loop pad 45 is positioned between the mating faces 43, 44. A connecting airway 46 is defined between the two mating bodies 41, 42. The connecting airway 46 passes through the mating faces 43, 44 to respectively communicate with the inlet 23 and internal airway of the pneumatic tool.

Substantially, the upper mating body 41 is a projecting loop 411 formed under bottom wall of the cylindrical body 31 corresponding to the position of the inlet 23. A first rectangular dent 412 is formed in the projecting loop 411. The first rectangular dent 412 is open to lower side. A perforation 413 is formed through the bottom wall 311 to communicate with the first dent 412. The first mating face 43 is formed on the peripheral face of bottom side of the projecting loop 411. The first mating face 43 is a slope inclined from the axis of the cylindrical body 31 and having a certain slope.

The lower mating body 42 has a generally U-shape with tapered legs (FIG. 3) and has a second dent 421 open to upper side. The shape of the second dent 421 corresponds to the shape of the first dent 412. The second dent 421 communicates with the inlet 23. A projecting loop 422 is formed around the second dent 421. The second mating face 44 is formed on the upper end face of the projecting loop 422. The second mating face 44 is a slope having a slope equal to the slope of the first mating face 43. Therefore, the second mating face 44 is reverse and complementary to the first mating face 43 and mated therewith.

After the mating bodies 41, 42 are mated with each other, the dents 421, 412 and the perforation 413 together form the connecting airway 46.

Figure 5A:
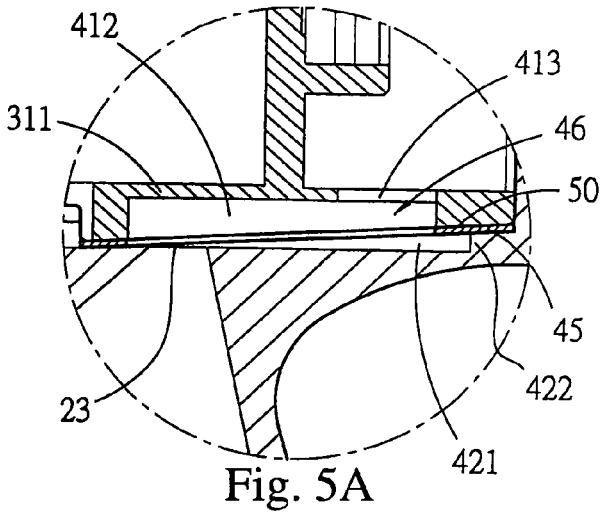
FIG. 5 is a sectional view taken along line 5—5 of FIG. 4.
Figure 5:
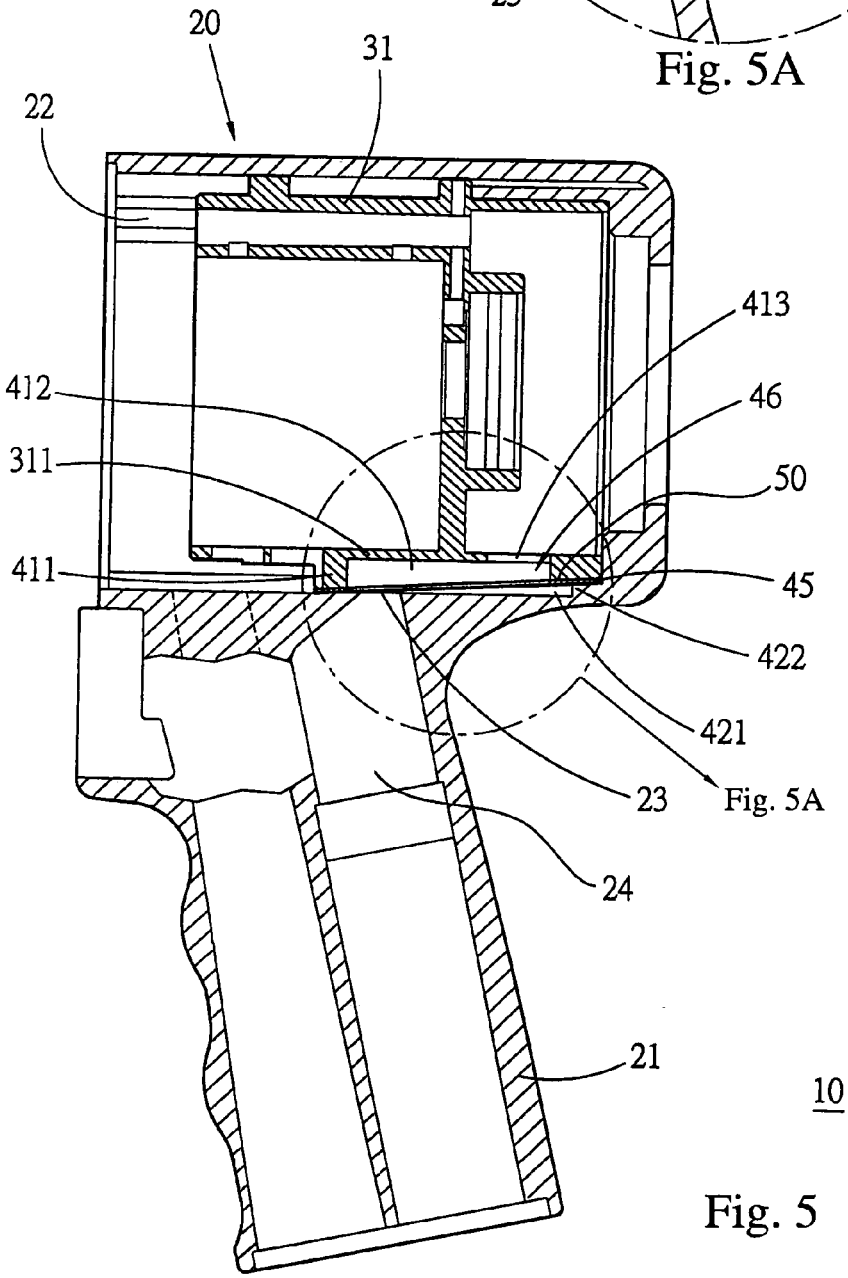
Figure 6:
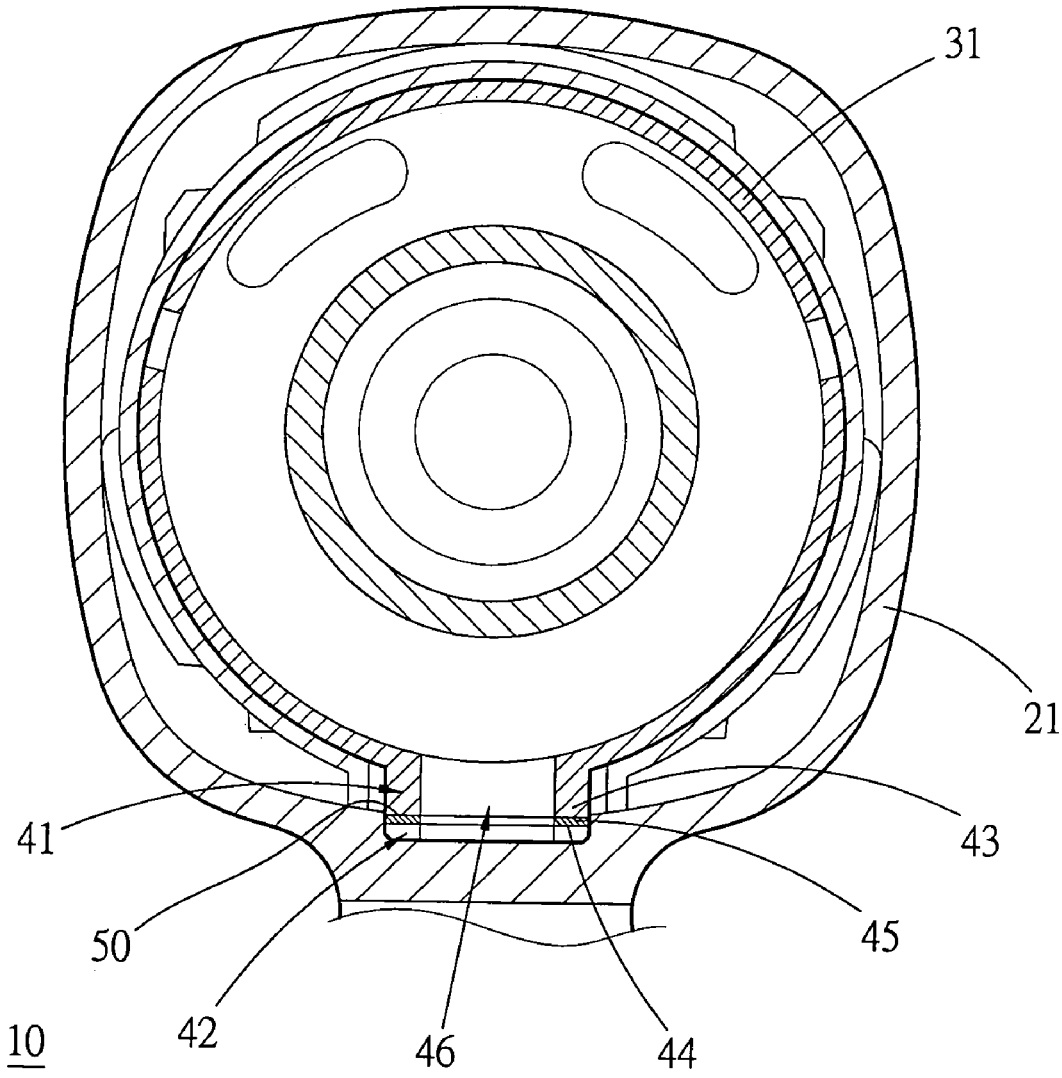
FIG. 6 is a sectional view taken along line 6—6 of FIG. 4.

When the cylinder member 30 is connected with the main body 20 by conventional connecting measure, the airway of the cylinder member 30 and the airway of the main body 20 are communicated via the connecting airway 46 of the connecting section 40. When the mating bodies 41, 42 are mated with each other, the airway loop pad 45 is sandwiched between the first and second mating faces 43, 44. In other words, the connecting face 50 between the mating faces 43, 44 is inclined from the axis of the cylindrical body 31 by a certain inclination (FIG. 5). Accordingly, although the connecting force provided by the conventional connecting member is parallel to the axis of the cylindrical body 31, a component force is created to the connecting face 50. Therefore, the mating faces 43, 44 can be more tightly mated to ensure the airtight effect and avoid escape of air.

The above embodiment is only used to illustrate the present invention, not intended to limit the scope thereof. Many modifications of the above embodiments can be made without departing from the spirit of the present invention. For example, the inclination angle can be varied.

What is claimed is:

1. An airway airtight structure of pneumatic tool, comprising:

a main body having a body section, a cylindrical chamber being formed in the body section, an inlet being formed in a predetermined position of a wall of the chamber for communicating with an incoming passage of the pneumatic tool;

a cylinder member having a hollow cylindrical body coaxially accommodated in the chamber, a wall of the cylindrical body being spaced from the inlet;

a connecting section positioned in a position where an opening of the inlet is directed, the connecting section being sandwiched between the cylindrical body and the wall of the chamber, the connecting section including two mating bodies mated with each other, a connecting face being positioned between the opposite mating ends of the mating bodies, the connecting face being inclined from the axis of the cylindrical body by a predetermined inclination angle, a connecting airway being formed on the mating bodies and extending through the connecting face to communicate with the inlet and wherein one of said mating bodies having a generally U-shape with tapered legs.

2. An airway airtight structure of pneumatic tool, comprising:

a main body having a body section, a cylindrical chamber being formed in the body section, an inlet being formed in a predetermined position of a wall of the chamber for communicating with an incoming passage of the pneumatic tool;

a cylinder member having a hollow cylindrical body coaxially accommodated in the chamber, a wall of the cylindrical body being spaced from the inlet;

a connecting section positioned in a position where an opening of the inlet is directed, the connecting section being sandwiched between the cylindrical body and the wall of the chamber, the connecting section including two mating bodies mated with each other, a connecting face being positioned between the opposite mating ends of the mating bodies, the connecting face being inclined from the axis of the cylindrical body by a predetermined inclination angle, a connecting airway being formed on the mating bodies and extending through the connecting face to communicate with the inlet and wherein one of said mating bodies having a generally U-shape with tapered legs.

3. An airway airtight structure of pneumatic tool comprising:

an airway airtight structure of pneumatic tool, comprising:

a main body having a body section, a cylindrical chamber being formed in the body section, an inlet being formed in a predetermined position of a wall of the chamber for communicating with an incoming passage of the pneumatic tool;

a cylinder member having a hollow cylindrical body coaxially accommodated in the chamber, a wall of the cylindrical body being spaced from the inlet;

a connecting section positioned in a position where an opening of the inlet is directed, the connecting section being sandwiched between the cylindrical body and the wall of the chamber, the connecting section including two mating bodies mated with each other, a connecting face being positioned between the opposite mating ends of the mating bodies, the connecting face being inclined from the axis of the cylindrical body by a predetermined inclination angle, a connecting airway being formed on the mating bodies and extending through the connecting face to communicate with the inlet and wherein one of said mating bodies having a generally U-shape with tapered legs; and wherein the connecting section has a first mating face formed on one side of one of the mating body and a second mating face formed on one side of the other of the mating body opposite to the first mating face, the first mating face being a slope inclined from the axis of the cylindrical body, the second mating face being mated with the first mating face to form the connecting face therebetween.

4. The airway airtight structure of pneumatic tool as claimed in claim 3, wherein the second mating face is a slope reverse to the first mating face, the second mating face having a slope equal to the slope of the first mating face.

5. The airway airtight structure of pneumatic tool as claimed in claim 3, wherein one of the mating bodies of the connecting section is a projecting loop formed on the cylindrical body corresponding to the position of the inlet, the first mating face being formed at a free end of the projecting loop.

6. The airway airtight structure of pneumatic tool as claimed in claim 3, wherein one of the mating bodies of the connecting section is formed on the wall of the chamber around the inlet, the second mating face being formed at one end of the mating body.

* * * * *